United States Patent [19]

Rawlings

[11] Patent Number: 4,645,464

[45] Date of Patent: Feb. 24, 1987

[54] STEERING AND TILTING MEANS FOR MARINE PROPULSION DEVICE

[75] Inventor: David E. Rawlings, Palatine, Ill.

[73] Assignee: Outboard Marine Corporation, Waukegan, Ill.

[21] Appl. No.: 698,873

[22] Filed: Feb. 6, 1985

[51] Int. Cl.[4] ..... B63H 21/26

[52] U.S. Cl. ..... 440/57

[58] Field of Search ..... 440/53, 57, 58–65, 440/112; 403/234–236, 261, 373, 383

[56] References Cited

U.S. PATENT DOCUMENTS

| | | | |
|---|---|---|---|
| 3,136,281 | 6/1964 | Kiekhaefer et al. | 440/12 |
| 3,136,285 | 6/1964 | Kiekhaefer | 440/57 |
| 3,136,287 | 6/1964 | North | 440/57 |
| 3,181,494 | 5/1965 | Kiekhaefer et al. | 440/64 |
| 3,250,501 | 5/1966 | Alexander | 440/57 |
| 3,403,655 | 10/1968 | Warburton | 440/57 |
| 3,434,448 | 3/1969 | Woodfill | 440/61 |
| 3,434,449 | 3/1969 | North | 440/61 |
| 3,834,345 | 9/1974 | Hager et al. | 440/57 |
| 4,165,708 | 8/1979 | Osswald | 440/61 |
| 4,289,488 | 9/1981 | Weronke et al. | 440/63 |

*Primary Examiner*—Galen Barefoot

*Assistant Examiner*—Jesûs D. Sotelo

*Attorney, Agent, or Firm*—Michael, Best & Friedrich

[57] ABSTRACT

A marine propulsion device comprising a gimbal housing adapted to be fixedly mounted on a boat transom, a gimbal ring pivotally mounted on the gimbal housing for pivotal movement relative to the gimbal housing about a generally vertical steering axis, the gimbal ring including a lower end, a support arm extending rearwardly from the lower end, and a generally horizontal cross-member extending across the lower end for preventing deflection of the support arm, a propulsion unit extending rearwardly of the gimbal ring and being pivotally connected to the gimbal ring for pivotal movement relative to the gimbal ring about a generally horizontal tilt axis, the propulsion unit including a portion extending adjacent the support arm for lateral support thereby, and a hydraulic cylinder/piston assembly pivotally connected between the gimbal ring and the propulsion unit for effecting pivotal movement of the propulsion unit relative to the gimbal ring about the tilt axis, the hydraulic cylinder/piston assembly having one end pivotally connected to the lower end of the gimbal ring for pivotal movement relative to the gimbal ring about a generally horizontal pivot axis.

29 Claims, 16 Drawing Figures

STEERING AND TILTING MEANS FOR MARINE PROPULSION DEVICE

BACKGROUND OF THE INVENTION

The invention relates to steering and tilting means for marine propulsion devices and, more particularly, to gimbal ring arrangements for stern drive or inboard/-outboard marine propulsion devices. Hydraulic cylinder/piston assemblies are connected between the ends of the pivot pin and the propulsion unit for effecting pivotal movement of the propulsion unit relative to the gimbal ring.

In prior marine propulsion devices, as is best shown in Prior Art FIGS. 1, 2 and 3, the lower cross-member 1 of the gimbal ring 2 is positioned above the support arms 4, or above a generally horizontal plane including the upper edges of the support arms 4, and a pivot pin 6 extends through aligned apertures in the lower ends of the side members 8 of the gimbal ring 2 and has opposite ends extending outwardly of the side members. The pivot pin 6 is positioned directly forwardly of the support arms 4 and below and cross-member 1. Hydraulic cylinder/piston assemblies are connected between the ends of the pivot pin 6 and the propulsion unit for effecting pivotal movement of the propulsion unit relative to the gimbal ring 2.

In these prior marine propulsion devices, as illustrated in FIG. 3, the result of the propeller thrust forces on the gimbal ring 2 is outward deflection or spreading of the support arms 4. This is caused by bending of the pivot pin 6 which results from the forces applied to the ends of the pivot pin 6 by the cylinder/piston assemblies. Outward deflection of the support arms 4 is undesirable because such deflection reduces the ability of the support arms 4 to absorb lateral forces applied to the propulsion unit.

Attention is directed to the following U.S. patents which disclose gimbal ring type steering means for marine propulsion devices:

Kiekhaefer U.S. Pat. No. 3,136,281, issued June 9, 1964;

Kiekhaefer U.S. Pat. No. 3,136,285, issued June 9, 1964;

North U.S. Pat. No. 3,136,287, issued June 9, 1964;

Kiekhaefer U.S. Pat. No. 3,181,494, issued May 4, 1965;

Alexander U.S. Pat. No. 3,250,501, issued May 10, 1966;

Warburton U.S. Pat. No. 3,403,655, issued Oct. 1, 1968;

Hager U.S. Pat. No. 3,834,345, issued Sept. 10, 1974; and

Weronke U.S. Pat. No. 4,289,488, issued Sept. 15, 1981.

SUMMARY OF THE INVENTION

The invention provides a marine propulsion device comprising a gimbal housing adapted to be fixedly mounted on a boat transom, a gimbal ring pivotally mounted on the gimbal housing for pivotal movement relative to the gimbal housing about a generally vertical steering axis, the gimbal ring including a lower end, a support arm extending rearwardly from the lower end, and means for preventing deflection of the support arm, a propulsion unit extending rearwardly of the gimbal ring and being pivotally connected to the gimbal ring for pivotal movement relative to the gimbal ring about a generally horizontal tilt axis, the propulsion unit including a portion extending adjacent the support arm for lateral support thereby, and a hydraulic cylinder/-piston assembly pivotally connected between the gimbal ring and the propulsion unit for effecting pivotal movement of the propulsion unit relative to the gimbal ring about the tilt axis, the hydraulic cylinder/piston assembly having one end pivotally connected to the lower end of the gimbal ring for pivotal movement relative to the gimbal ring about a generally horizontal pivot axis.

In one embodiment, the support arm has upper and lower edges, and the means for preventing deflection of the supporting arm includes a generally horizontal cross-member extending across the lower end and being positioned between a generally horizontal upper plane including the upper edge of the support arm, and a generally horizontal lower plane including the lower edge of the support arm.

The invention also provides a marine propulsion device comprising a gimbal housing adapted to be fixedly mounted on a boat transom, a gimbal ring pivotally mounted on the gimbal housing for pivotal movement relative to said gimbal housing about a generally vertical steering axis, the gimbal ring including opposite sides and a lower end, a pair of spaced apart support arms extending rearwardly from the lower end, and means for preventing deflection of the support arms, a propulsion unit extending rearwardly of the gimbal ring and being pivotally connected to the gimbal ring for pivotal movement relative to the gimbal ring about a generally horizontal tilt axis, the propulsion unit including a portion extending between the support members for lateral support thereby, and a pair of hydraulic cylinder/piston assemblies pivotally connected between the gimbal ring and the propulsion unit for effecting pivotal movement of the propulsion unit relative to the gimbal ring about the tilt axis, one of the hydraulic cylinder/piston assemblies having one end pivotally connected to one side of the gimbal ring for pivotal movement relative to the gimbal ring about a generally horizontal pivot axis, and the other of the hydraulic cylinder/piston assemblies having one end pivotally connected to the other side of the gimbal ring for pivotal movement relative to the gimbal ring about the pivot axis.

In one embodiment, the support arms have upper and lower edges, and the means for preventing deflection includes a generally horizontal cross-member extending across the lower end and being positioned between a generally horizontal upper plane including the upper edges of the support arms, and a generally horizontal lower plane including the lower edges of the support arms.

In one embodiment of the above, the pivot axis passes through the cross-member.

In one embodiment, the deflection preventing means includes a generally horizontal cross-member having a rearward edge and extending across the lower end of the gimbal ring such that the pivot axis is located forwardly of the rearward edge of the cross-member and in a horizontal plane passing through the cross-member.

In one embodiment of the above, the pivot axis passes through the cross-member.

In one embodiment, the deflection preventing means includes a generally horizontal cross-member extending across the lower end of the gimbal ring such that the pivot axis is located above the cross-member.

In one embodiment, the opposite sides of the gimbal ring are separated by a given distance and each includes an aperture centered on the pivot axis, the gimbal ring further includes a pivot pin extending through the apertures along the pivot axis and having one end extending outwardly of one of the sides of the gimbal ring, and an opposite end extending outwardly of the other of the sides of the gimbal ring, one of the hydraulic cylinder/-piston assemblies has one end connected to one end of the pivot pin for pivotal movement relative to the gimbal ring about the pivot axis, and the other of the hydraulic cylinder/piston assemblies has one end connected to the other end of the pivot pin for pivotal movement relative to the gimbal ring about the pivot axis, and the deflection preventing means includes a rigidifying sleeve surrounding the pivot pin between the opposite sides of the gimbal ring and having a length substantially equal to the given distance separating the opposite sides.

The invention also provides a gimbal ring adapted to be pivotally mounted on a boat transom for pivotal movement relative to the boat transom about a generally vertical steering axis, and also adapted to support a propulsion unit for pivotal movement relative to the gimbal ring about a generally horizontal tilt axis, the gimbal ring comprising a lower end, a pair of spaced apart support arms extending rearwardly from the lower end, and means for preventing deflection of the support arms.

In one embodiment, the support arms have upper and lower edges, and the deflection preventing means includes a generally horizontal cross-member extending across the lower end of the gimbal ring and being positioned between a generally horizontal upper plane including the upper edges of the support arms, and a generally horizontal lower plane including the lower edges of the support arms.

In one embodiment, the gimbal ring further comprises opposite sides, and a generally horizontal pivot axis, the gimbal ring is adapted to have a pair of hydraulic cylinder/piston assemblies pivotally connected between the gimbal ring and the propulsion unit for effecting pivotal movement of the propulsion unit relative to the gimbal ring about the tilt axis, one of the hydraulic cylinder/piston assemblies having one end pivotally connected to one side of the gimbal ring for pivotal movement relative to the gimbal ring about the pivot axis, and the other of said hydraulic cylinder/piston assemblies having one end pivotally connected to the other side of the gimbal ring for pivotal movement relative to the gimbal ring about the pivot axis, and the deflection preventing means includes a generally horizontal cross-member having a rearward edge and extending across the lower end of the gimbal ring such that the pivot axis is located forwardly of the rearward edge of the cross-member and in a horizontal plane passing through the cross-member.

In one embodiment of the above, the pivot axis passes through the cross-member.

In one embodiment, the gimbal ring further comprises opposite sides, and a generally horizontal pivot axis, the gimbal ring is adapted to have a pair of hydraulic cylinder/piston assemblies connected between the gimbal ring and the propulsion unit for effecting pivotal movement of the propulsion unit relative to the gimbal ring about the tilt axis, one of the hydraulic cylinder/-piston assemblies having one end pivotally connected to one side of the gimbal ring to pivotal movement relative to the gimbal ring about the pivot axis, and the other of the hydraulic cylinder/piston assemblies having one end pivotally connected to the other side of the gimbal ring for pivotal movement relative to the gimbal ring about the pivot axis, and the deflection preventing means includes a generally horizontal cross-member extending across the lower end such that the pivot axis is located above the cross-member.

In one embodiment, the gimbal ring further comprises opposite sides separated by a given distance and each including an aperture centered on a generally horizontal pivot axis, and a pivot pin extending through the apertures along the pivot axis and having one end extending outwardly of one of the sides of the gimbal ring, and an opposite end extending outwardly of the other of the sides of the gimbal ring, the gimbal ring is adapted to have a pair of hydraulic cylinder/piston assemblies connected between the gimbal ring and the propulsion unit for effecting pivotal movement of the propulsion unit relative to the gimbal ring about the tilt axis, one of the hydraulic cylinder/piston assemblies having one end pivotally connected to one end of the pivot pin for pivotal movement relative to the gimbal ring about the pivot axis, and the other of the hydraulic cylinder/piston assemblies having one end pivotally connected to the other end of the pivot pin for pivotal movement relative to the gimbal ring about the pivot axis, and the deflection preventing means includes a rigidifying sleeve surrounding the pivot pin between the opposite sides of the gimbal ring and having a length substantially equal to the given distance separating the opposite sides.

A principal feature of the invention is the provision of a marine propulsion device including means for preventing spreading or outward deflection of the support arms.

Another principal feature of the invention is the provision of a gimbal ring including a lower cross-member positioned between a generally horizontal upper plane including the upper edges of the support arms, and a generally horizontal lower plane including the lower edges of the support arms.

Another principal feature of the invention is the provision of a marine propulsion device wherein the hydraulic cylinder/piston assemblies are pivotally connected to the gimbal ring for pivotal movement relative to the gimbal ring about a generally horizontal pivot axis located forwardly of the rear edge of the lower cross-member and in a horizontal plane passing through the lower cross-member of the gimbal ring.

Another principal feature of the invention is the provision of a marine propulsion device wherein the hydraulic cylinder/piston assemblies are pivotally connected to the gimbal ring for pivotal movement relative to the gimbal ring about a generally horizontal pivot axis located above the lower cross-member.

Other features and advantages of the invention will become apparent to those skilled in the art upon review of the following detailed description, claims, and drawings.

Figure 8:
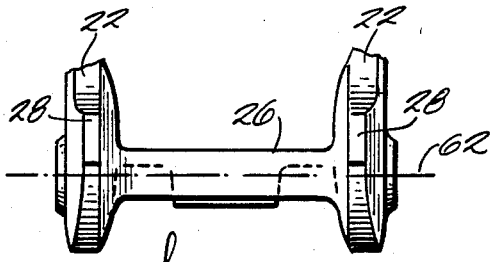
FIG. 8 is a partial rear view of the lower end of the gimbal ring.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is a marine propulsion device 10 mounted on a boat 12 having a transom 14. The marine propulsion device 10 is of the stern drive or inboard/outboard type.

Figure 4:
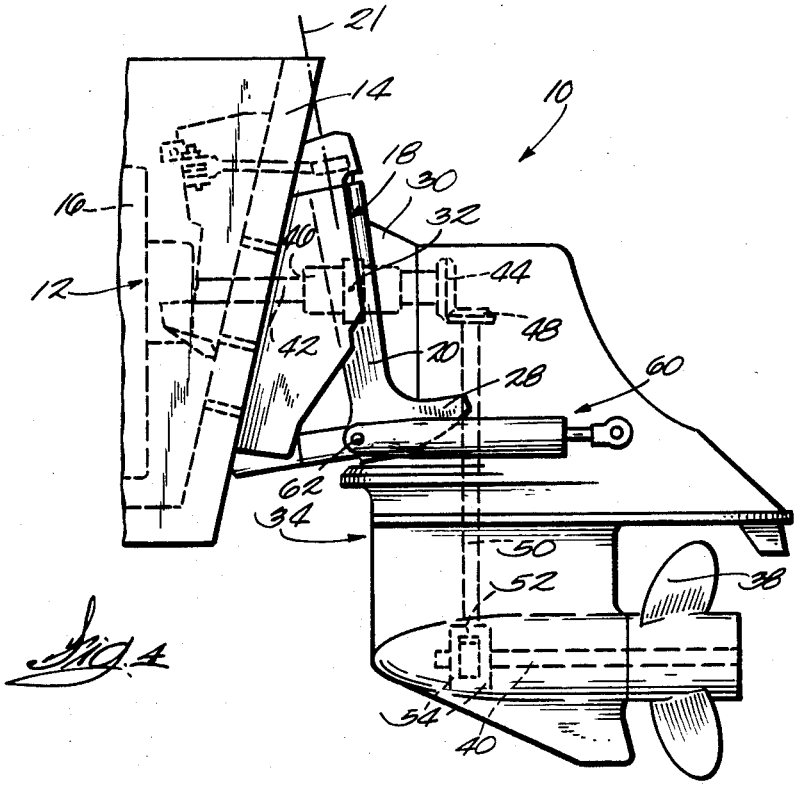
FIG. 4 is a side elevational view of a marine propulsion device embodying the invention.

As best shown in FIG. 4, the marine propulsion device 10 comprises an engine 16 securely mounted on the boat frame by suitable means such as rubber mounts (not shown). The marine propulsion device 10 also comprises a gimbal housing 18 mounted on the outer surface of the boat transom 14 and fixedly attached to the boat transom 14. The gimbal housing 18 can be attached to the boat transom 14 by any suitable means. such as bolts extending through the transom 14.

The marine propulsion device 10 also comprises a gimbal ring 20 connected to the gimbal housing 18 for pivotal movement relative to the gimbal housing 18 about a generally vertical steering axis 21, and a pivot housing 30 connected to the gimbal ring 20 for pivotal movement relative to the gimbal ring 20 about a generally horizontal tilt axis 32. Such a construction is well known in the art and need not be described in greater detail.

The marine propulsion device 10 also comprises a propulsion unit 34 removably connected to the pivot housing 30 for common pivotal movement of the propulsion unit 34 with the pivot housing 30. In the illustrated construction, the propulsion unit 34 is removably connected to the pivot housing 30 by a plurality of bolts (not shown). The propulsion unit 34 includes a propeller 38 mounted on a propeller shaft 40, and a generally horizontal drive shaft 42 having one end removably connected to the engine 16 and an opposite end having thereon a bevel gear 44. A universal joint 46 in the horizontal drive shaft 42 allows pivotal movement of the drive shaft 42 with the propulsion unit 34. The bevel gear 44 drives a bevel gear 48 on the upper end of a vertical drive shaft 50. The lower end of the vertical drive shaft 50 has thereon a driving gear 52. A reversible transmission selectively clutches a pair of driven gears 54 to the propeller shaft 40 to transmit forward or reverse motion to the propeller shaft 40 from the driving gear 52.

Figure 5:
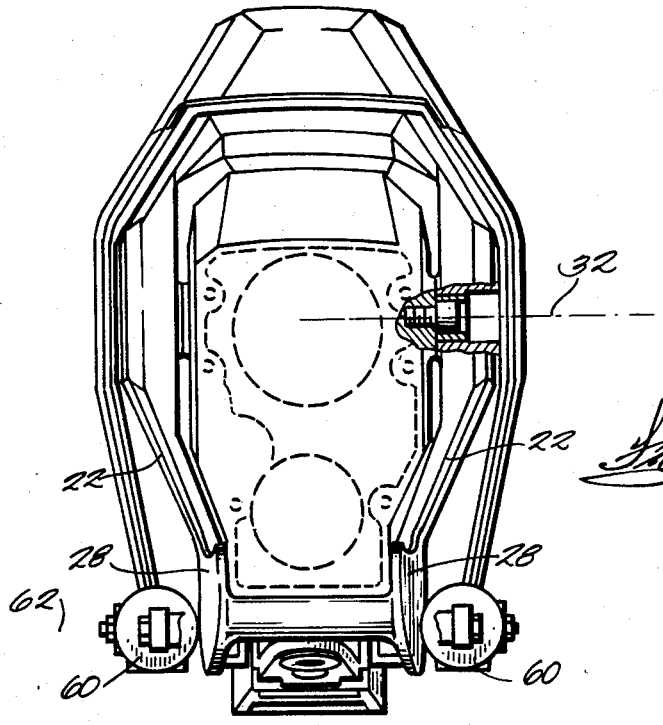
FIG. 5 is a rear view (from the right in FIG. 4) of the marine propulsion device with the propulsion unit removed.

The marine propulsion device 10 also comprises a pair of hydraulic cylinder/piston assemblies 60 pivotally connected between the gimbal ring 20 and the propulsion unit 34 for effecting pivotal movement (tilt and trim movement) of the propulsion unit 34 relative to the gimbal ring 20 about the tilt axis 32. The cylinder/piston assemblies 60 extend on opposite sides of the propulsion unit 34. Only one cylinder/piston assembly 60 is shown in FIG. 4. Both are shown in FIG. 5.

Figure 6:
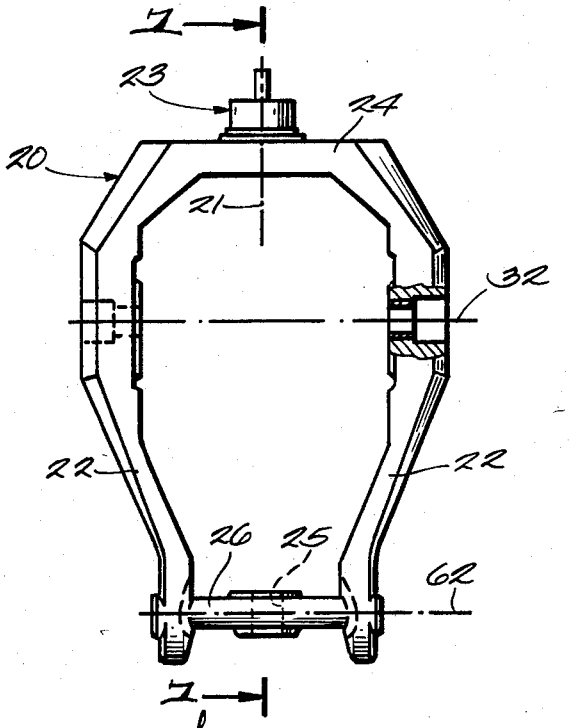
FIG. 6 is a front view (from the left in FIG. 4) of the gimbal ring.
Figure 7:
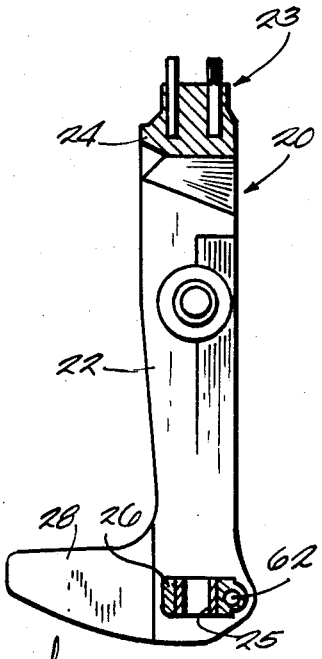
FIG. 7 is a cross-sectional view taken along line 7—7 in FIG. 6.

In the illustrated construction, as best shown in FIGS. 6 and 7, the gimbal ring 20 actually has a shape that is more rectangular than circular, although the gimbal ring 20 could have other shapes. In the preferred embodiment, the gimbal ring 20 includes a pair of spaced apart, generally vertical side members 22, and a pair of spaced apart, generally horizontal upper and lower cross-members 24 and 26, respectively, defining a main opening. As is well known in the art, in the preferred embodiment, the upper and lower cross-members 24 and 26 are pivotally connected to the gimbal housing 18 for pivotal movement of the gimbal ring 20 relative to the gimbal housing 18 about the steering axis 21. This pivotal connection can be made by any suitable means. In the illustrated construction, a pin 23 extending upwardly from the upper cross-member 24 of the gimbal ring 20 is received in an aperture in the gimbal housing 18, and an aperture 25 in the lower cross-member 26 of the gimbal ring 20 receives a pin extending from the gimbal housing 18. Both the aperture in the gimbal housing 18 and the pin extending from the gimbal housing 18 are centered on the steering axis 21.

Extending rearwardly from the lower end of each of the vertical side members 22 of the gimbal ring 20 is a support arm 28 having upper and lower edges. The support arms 28 extend rearwardly from the gimbal ring 20 and extend adjacent portions of the propulsion unit 34 and pivot housing 30, as best shown in FIG. 4. The support arms 28 serve to additionally absorb lateral forces applied to the propulsion unit 34. (The bulk of lateral support for the propulsion unit 34 is provided by the pivotal connection of the pivot housing 30 to the gimbal ring 20.)

One of the hydraulic cylinder/piston assemblies 60 has one end pivotally connected to one of the side members 22 of the gimbal ring 20 for pivotal movement relative to the gimbal ring 20 about a generally horizontal pivot axis 62, and an opposite end pivotally connected to the propulsion unit 34. The other of the hydraulic cylinder/piston assemblies 60 has one end pivotally connected to the other of the side members 22 of the gimbal ring 20 for pivotal movement relative to the gimbal ring 20 about the pivot axis 62, and an opposite end pivotally connected to the propulsion unit 34.

During operation of a marine propulsion device 10 such as described above, propeller thrust forces on the propulsion unit 34 are applied to the gimbal ring 20 primarily at the tilt axis 32 (at the connection of the pivot housing 30 to the gimbal ring 20) and at the pivot axis 62 (at the connection of the hydraulic cylinder/piston assemblies 60 to the gimbal ring 20). Reaction forces on the gimbal ring 20 occur at the pivotal connections of the gimbal ring 20 to the gimbal housing 18.

To avoid spreading or outward deflection of the support arms 28 due to these forces on the gimbal ring 20, the gimbal ring 20 includes means for preventing deflection of the support arms 28. In other words, the construction of the gimbal ring 20 and the connection of the hydraulic cylinder/piston assemblies 60 to the gimbal ring 20 are such that outward deflection of the support arms 28 due to forces on the gimbal ring 20 is substantially avoided. In the preferred embodiment, as best shown in FIGS. 7 and 8, the means for preventing deflection of the support arms 28 includes the lower cross-member 26 of the gimbal ring 20 which is positioned directly forwardly of the support arms 28, or between a generally horizontal upper plane including the upper edges of the support arms 28, and a generally horizontal lower plane including the lower edges of the support arms 28. Also, the pivot axis 62 is located forwardly (to the left in FIG. 4) of the rearward edge of the lower cross-member 26. With this arrangement, the lower cross-member 26 rigidifies the lower ends of the side members 22 of the gimbal ring 20 adjacent the support arms 28 so as to substantially prevent outward deflection of the support arms 28.

Figure 1:
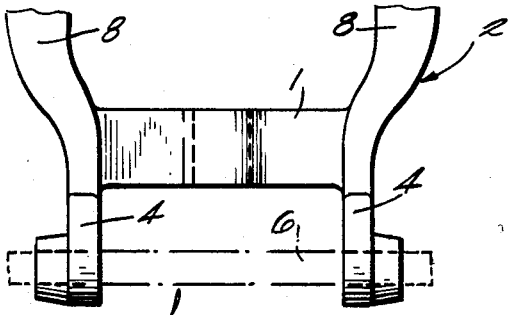
Fig. 1 PRIOR ART
FIG. 1 is a partial rear view of the lower end of a prior art gimbal ring.
Figure 9:
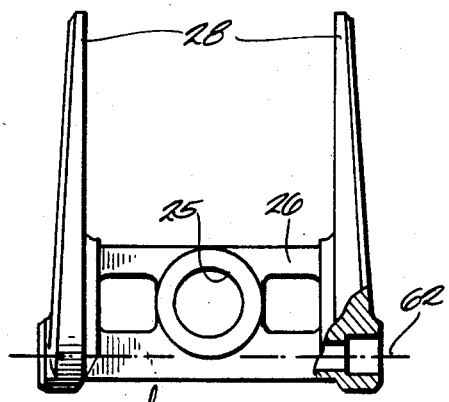
FIG. 9 is a bottom view of the gimbal ring.

It should be understood that in alternative embodiments of the invention the cross-member 26 can be simply a rigidifying member and need not be connected to the gimbal housing 18 as in the preferred embodiment. For example, the gimbal ring could have two lower cross-members, with one being positioned forwardly of the support arms as described above, and with the other being positioned above the support arms and connected to the gimbal housing as shown in Prior Art FIG. 1.

Figure 10:
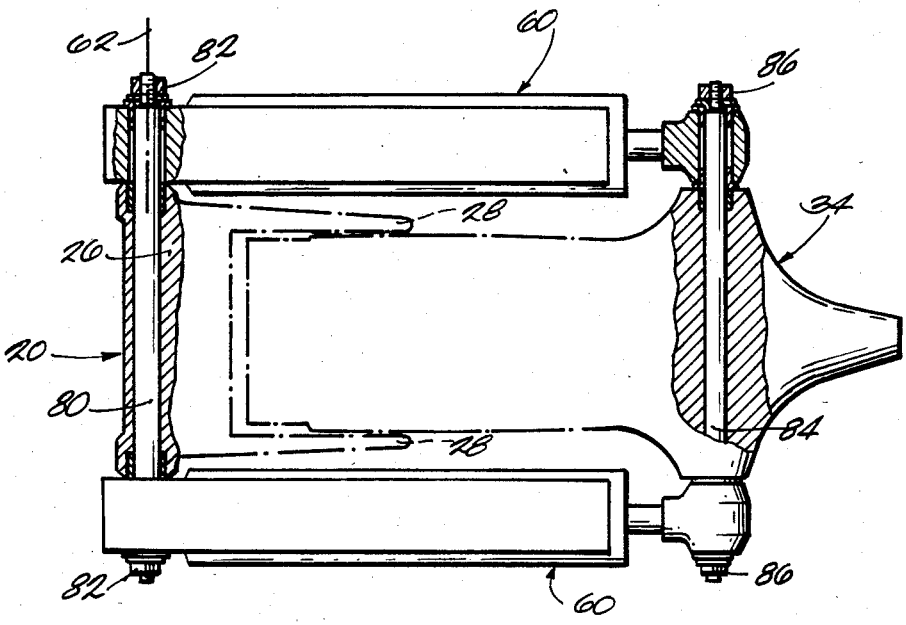
FIG. 10 is a bottom view, partially in cross-section, of the gimbal ring, propulsion unit, and cylinder/piston assemblies.

In the preferred embodiment, as best shown in FIGS. 7 through 10, the pivot axis 62 passes through the lower cross-member 26. The gimbal ring 20 includes an elongated opening extending through the side members 22 and the lower cross-member 26 along the pivot axis 62, and the opening receives a pivot pin 80 having one end extending outwardly of one of the side members 22 and having the end of one of the hydraulic cylinder/piston assemblies 60 mounted thereon, and an opposite end extending outwardly of the other of the side members 22 and having the end of the other of the hydraulic cylinder/piston assemblies 60 mounted thereon. As shown in FIG. 10, the ends of the pivot pin 80 are threaded, and the cylinder/piston assemblies 60 are secured to the ends of the pivot pin 80 by nuts 82. Because the pivot pin 80 is housed within the lower cross-member 26, bending of the pivot pin 80, which can cause outward deflection of the support arms 28, is substantially prevented.

As is also best shown in FIG. 10, the opposite or rearward ends of the cylinder/piston assemblies 60 are pivotally connected to the propulsion unit 34 is a similar manner. A pivot pin 84 extends horizontally through the propulsion unit 34, and the cylinder/piston assemblies are mounted on the opposite ends of the pivot pin 84. The ends of the pivot pin 84 are threaded, and the cylinder/piston assemblies 60 are secured by nuts 86.

Figure 11:
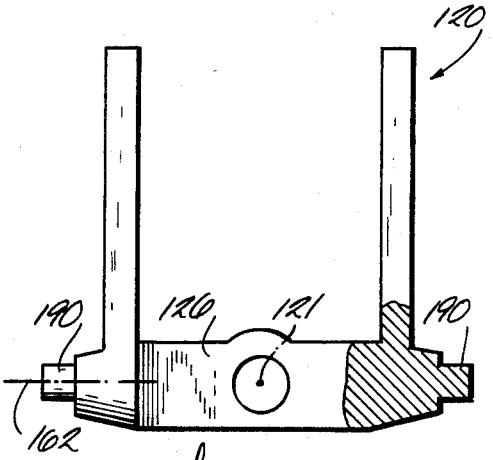
FIG. 11 is a bottom view of a gimbal ring which is an alternative embodiment of the invention.

FIG. 11 is a bottom view of an alternative embodiment of the invention in which the pivot axis 162 also passes through the lower cross-member 126. However, in this alternative embodiment, the forward ends of the hydraulic cylinder/piston assemblies are mounted on projections 190 extending outwardly from the side members of the gimbal ring 120 along the pivot axis 162. In the illustrated construction, the pivot axis 162 intersects the steering axis 121.

Figure 2:
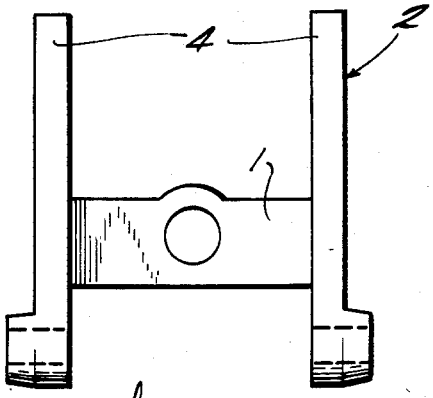
Fig. 2 PRIOR ART
FIG. 2 is a bottom view of the prior art gimbal ring shown in FIG. 1.
Figure 3:
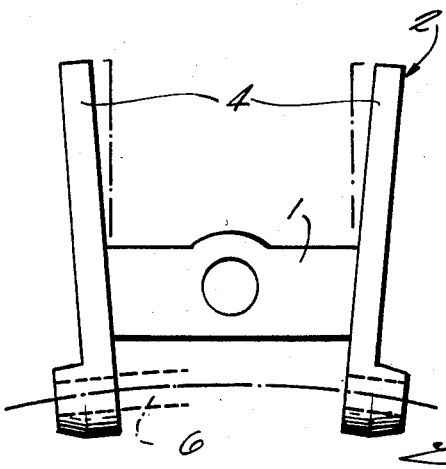
Fig. 3 PRIOR ART
FIG. 3 illustrates the outward deflection of the support arms of the prior art gimbal ring.
Figure 12:
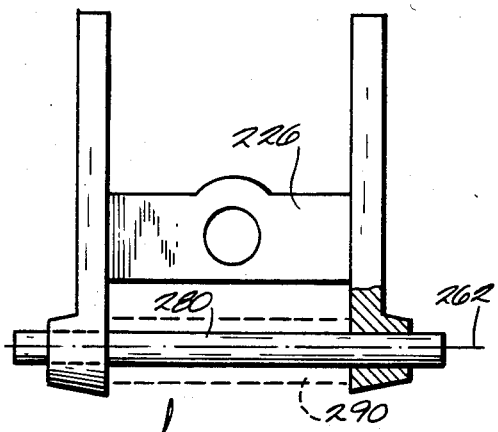
FIG. 12 is a bottom view of a gimbal ring which is an alternative embodiment of the invention.

FIG. 12 is a bottom view of another alternative embodiment of the invention. In this construction, the pivot axis 262 is located forwardly of the rear edge of the lower cross-member 226 and in a generally horizontal plane passing through the lower cross-member 226. However, the pivot pin 280 does not extend through the lower cross-member 226. Instead, each of the side members includes an aperture centered on the pivot axis 262, and the pivot pin 280 extends through the apertures along the pivot axis 262. It should be noted that the gimbal ring shown in FIG. 12 differs from the prior art gimbal rings shown in FIGS. 1 through 3 in that the pivot axis 262 is in the horizontal plane of the cross-member 226, rather than below the cross-member.

In another alternative embodiment of the invention, the means for preventing outward deflection of the support arms includes a rigidfying sleeve 290 (shown in dotted lines in FIG. 12) surrounding the pivot pin 280 and having a length equal to the distance between the side members of the gimbal ring. The sleeve 290 both prevents bending of the pviot pin 280 and prevents the side members of the gimbal ring from moving closer together (as shown in Prior Art FIG. 3) and causing outward movement of the support arms.

In another alternative embodiment of the invention (not shown), the means for preventing deflection of the support arms includes a pivot pin with the portion of the pivot pin extending between the side members of the gimbal ring having an enlarged diameter so as to resist bending of the pivot pin and so as to prevent the side members of the gimbal ring from moving closer together.

Figure 13:
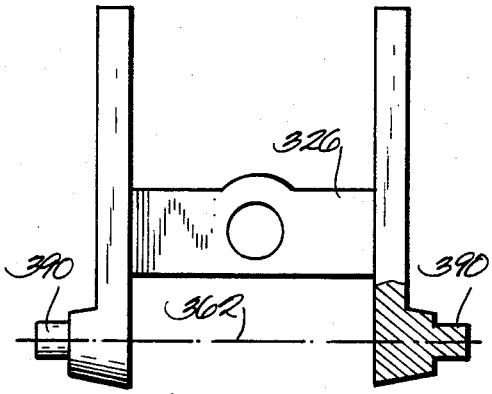
FIG. 13 is a bottom view of a gimbal ring which is an alternative embodiment of the invention.
Figure 14:
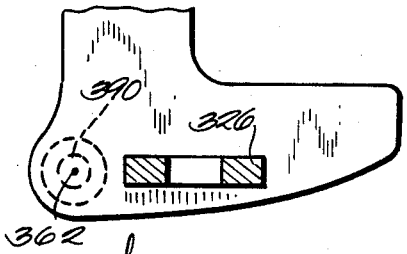
FIG. 14 is a vertical cross-sectional view of the lower end of the gimbal ring illustrated in FIG. 13.

Illustrated in FIGS. 13 and 14 is another alternative embodiment of the invention similar to the alternative embodiment illustrated in FIG. 12. The pivot axis 362 is located forwardly of the rear edge of the lower cross-member 326 and in a generally horizontal plane passing through the lower cross-member 326. However, in the construction illustrated in FIGS. 13 and 14, the forward ends of the hydraulic cylinder/piston assemblies are attached to projections 390 similar to the projections 190 shown in FIG. 11, rather than to the ends of a pivot pin. The gimbal ring of FIGS. 13 and 14 differs from the prior art in that the pivot axis 362 is in the horizontal plane of the cross-member 326, rather than below the cross-member.

Figure 15:
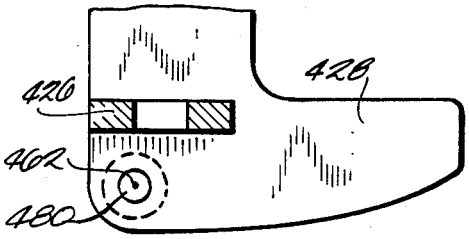
FIG. 15 is a vertical cross-sectional view of a gimbal ring which is an alternative embodiment of the invention.

Illustrated in FIG. 15 is another alternative embodiment of the invention. In this construction, the lower cross-member 426 is positioned between a generally horizontal upper plane including the upper edges of the support arms 428, and a generally horizontal lower plane including the lower edges of the support arms 428. The pivot axis 462 is located beneath the lower cross-member 426, so that the pivot pin 480 is located beneath the lower cross-member 426.

Figure 16:
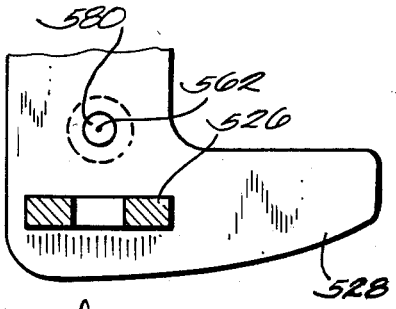
FIG. 16 is a vertical cross-sectional view of a gimbal ring which is an alternative embodiment of the invention.

Illustrated in FIG. 16 is another alternative embodiment of the invention. In this alternative embodiment, the means for preventing deflection of the support arms includes the lower cross-member 526 which is positioned such that the pivot axis 562 is located above the lower cross-member 526. In the illustrated construction, the pivot axis 562 and pivot pin 580 are also located above the upper edges of the support arms 528, although the pivot axis 562 could be located beneath the upper edges of the support arms 528.

In all of the alternative embodiments illustrated in FIGS. 11 through 16, the construction of the gimbal ring is such that outward deflection of the support arms is substantially avoided.

Various features and advantages of the invention are set forth in the following claims.

I claim:

1. A marine propulsion device comprising a gimbal housing adapted to be fixedly mounted on a boat transom, a gimbal ring pivotally mounted on said gimbal housing for pivotal movement relative to said gimbal housing about a generally vertical steering axis, said gimbal ring including a lower end, a support arm extending rearwardly from said lower end, and means for preventing deflection of said support arm, a propulsion unit extending rearwardly of said gimbal ring and being pivotally connected to said gimbal ring for pivotal movement relative to said gimbal ring about a generally horizontal tilt axis, said propulsion unit including a portion extending adjacent said support arm for lateral support thereby, and a hydraulic cylinder/piston assembly extending generally horizontally between said gimbal ring and said propulsion unit when said propulsion unit is in a normal running position and being pivotally connected between said gimbal ring and said propulsion unit for effecting pivotal movement of said propulsion unit relative to said gimbal ring about said tilt axis, said hydraulic cylinder/piston assembly having one end directly pivotally connected to said lower end of said gimbal ring for pivotal movement relative to said gimbal ring about a generally horizontal pivot axis.

2. A marine propulsion device as set forth in claim 1 wherein said support arm has upper and lower edges, and wherein said means for preventing deflections of said supporting arm includes a generally horizontal cross-member extending across said lower end and being positioned between a generally horizontal upper plane including said upper edge of said support arm, and a generally horizontal lower plane including said lower edge of said support arm.

3. A marine propulsion device comprising a gimbal housing adapted to be fixedly mounted on a boat transom, a gimbal ring pivotally mounted on said gimbal housing for pivotal movement relative to said gimbal housing about a generally vertical steering axis, said gimbal ring including opposite sides and a lower end, a pair of spaced apart support arms extending rearwardly from said lower end, and means for preventing deflection of said support arms, a propulsion unit extending rearwardly of said gimbal ring and being pivotally connected to said gimbal ring for pivotal movement relative to said gimbal ring about a generally horizontal tilt axis, said propulsion unit including a portion extending between said support arms for lateral support thereby, and a pair of hydraulic cylinder/piston assemblies extending generally horizontally between said gimbal ring and said propulsion unit when said propulsion unit is in a normal running position and being pivotally connected between said gimbal ring and said propulsion unit for effecting pivotal movement of said propulsion unit relative to said gimbal ring about said tilt axis, one of said hydraulic cylinder/piston assemblies having one end pivotally connected to one side of said gimbal ring for pivotal movement relative to said gimbal ring about a generally horizontal pivot axis, and the other of said hydraulic cylinder/piston assemblies having one end pivotally connected to the other side of said gimbal ring for pivotal movement relative to said gimbal ring about said pivot axis.

4. A marine propulsion device as set forth in claim 3 wherein said support arms have upper and lower edges, and wherein said means for preventing deflection includes a generally horizontal cross-member extending across said lower end and being positioned between a generally horizontal upper plane including said upper edges of said support arms, and a generally horizontal lower plane including said lower edges of said support arms.

5. A marine propulsion device as set forth in claim 4 wherein said cross-member has a rearward edge, and wherein said pivot axis is located forwardly of said rearward edge of said cross-member.

6. A marine propulsion device comprising a gimbal housing adapted to be fixedly mounted on a boat transom, a gimbal ring pivotally mounted on said gimbal housing for pivotal movement relative to said gimbal housing about a generally vertical steering axis, said gimbal ring including opposite sides and a lower end, a pair of spaced apart support arms extending rearwardly from said lower end, and means for preventing deflection of said support arms and including, at said lower end, a generally horizontally extending cross-member, a propulsion unit extending rearwardly of said gimbal ring and being pivotally connected to said gimbal ring for pivotal movement relative to said gimbal ring about a generally horizontal tilt axis, said propulsion unit including a portion extending between said support arms for lateral support thereby, and a pair of hydraulic cylinder/piston assemblies pivotally connected between said gimbal ring and said propulsion unit for effecting pivotal movement of said propulsion unit relative to said gimbal ring about said tilt axis, one of said hydraulic cylinder/piston assemblies having one end pivotally connected to one side of said gimbal ring for pivotal movement relative to said gimbal ring about a generally horizontal pivot axis passing through said cross-member, and the other of said hydraulic cylinder/piston assemblies having one end pivotally connected to the other side of said gimbal ring for pivotal movement relative to said gimbal ring about said pivot axis.

7. A marine propulsion device comprising a gimbal housing adapted to be fixedly mounted on a boat transom, a gimbal ring pivotally mounted on said gimbal housing for pivotal movement relative to said gimbal housing about a generally vertical steering axis, said gimbal ring including a pair of generally vertical opposite side members including respective lower ends respectively having therein co-axial apertures, a pair of spaced apart support arms respectively extending rearwardly from said lower ends, and means for preventing deflection of said support arms, said deflection preventing means including a generally horizontal cross-member extending between said lower ends, and a propulsion unit extending rearwardly of said gimbal ring and being pivotally connected to said gimbal ring for pivotal movement relative to said gimbal ring about a generally horizontal tilt axis, said propulsion unit including a portion extending between said support arms for lateral support thereby, a pivot pin extending through said apertures along a generally horizontal pivot axis and having one end extending outwardly of one of said side members and an opposite end extending outwardly of the other of said side members, and a pair of hydraulic cylinder/piston assemblies pivotally connected between said gimbal ring and said propulsion unit for effecting pivotal movement of said propulsion unit relative to said gimbal ring about said tilt axis, one of said hydraulic cylinder/piston assemblies having one end pivotally connected to said one end of said pivot pin for pivotal movement relative to said gimbal ring about said generally horizontal pivot axis, and the other of said hydraulic cylinder/piston assemblies having one end pivotally connected to said opposite end of said movement relative to said gimbal ring about said generally horizontal pivot axis.

8. A marine propulsion device as set forth in claim 7 wherein said pivot axis passes through said cross-member, and wherein said cross-member includes an elongated opening pivotally receiving said pivot pin.

9. A marine propulsion device comprising a gimbal housing adapted to be fixedly mounted on a boat transom, a gimbal ring pivotally mounted on said gimbal housing for pivotal movement relative to said gimbal housing about a generally vertical steering axis, said gimbal ring including opposite sides having respective lower ends, a pair of spaced apart support arms respectively extending rearwardly from said lower ends, and means for preventing deflection of said support arms, said deflection preventing means including, at said lower end, a generally horizontal cross-member having a rearward edge, a propulsion unit extending rearwardly of said gimbal ring and being pivotally connected to said gimbal ring for pivotal movement relative to said gimbal ring about a generally horizontal tilt axis, said propulsion unit including a portion extending between said support arms for lateral support thereby, and a pair of hydraulic cylinder/piston assemblies pivotally connected between said gimbal ring and said propulsion unit for effecting pivotal movement of said propulsion unit relative to said gimbal ring about said tilt axis, one of said hydraulic cylinder/piston assemblies having one end pivotally connected to one side of said gimbal ring for pivotal movement relative to said gimbal ring about a generally horizontal pivot axis located forwardly of said rearward edge of said cross-member and in a horizontal plane passing through said cross-member, and the other of said hydraulic cylinder/piston assemblies having one end pivotally connected to the other side of said gimbal ring for pivotal movement relative to said gimbal ring about said generally horizontal pivot axis.

10. A marine propulsion device as set forth in claim 9 wherein said gimbal ring further includes a pair of generally vertical, spaced apart side members each including a lower end, wherein said cross-member connects said side members of said gimbal ring, and wherein one of said support arms extends rearwardly from said lower end of one of said side members, and the other of said support arms extends rearwardly from said lower end of the other of said side members.

11. A marine propulsion device as set forth in claim 10 wherein each of said side members of said gimbal ring further includes an aperture centered on said pivot axis, and wherein said marine propulsion device further comprises a pivot pin extending through said apertures along said pivot axis and having one end extending outwardly of one of said side members and having said one end of said one of said hydraulic cylinder/piston assemblies pivotally mounted thereon, and an opposite end extending outwardly of the other of said side members of said gimbal ring and having said one end of said other of said hydraulic cylinder/piston assemblies pivotally mounted thereon.

12. A marine propulsion device as set forth in claim 11 wherein said cross-member includes an elongated opening pivotally receiving said pivot pin.

13. A marine propulsion device comprising a gimbal housing adapted to be fixedly mounted on a boat transom, a gimbal ring pivotally mounted on said gimbal housing for pivotal movement relative to said gimbal housing about a generally vertical steering axis, said gimbal ring including opposite sides having respective lower ends, a pair of spaced apart support arms respectively extending rearwardly from said lower ends, and means for preventing deflection of said support arms and including, a generally horizontal cross-member extending between said lower ends, a propulsion unit extending rearwardly of said gimbal ring and being pivotally connected to said gimbal ring for pivotal movement relative to said gimbal ring about a generally horizontal tilt axis, said propulsion unit including a portion extending between said support arms for lateral support thereby, and a pair of hydraulic cylinder/piston assemblies pivotally connected between said gimbal ring and said propulsion unit for effecting pivotal movement of said propulsion unit relative to said gimbal ring about said tilt axis, one of said hydraulic cylinder/piston assemblies having one end pivotally connected to one side of said gimbal ring for pivotal movement relative to said gimbal ring about a generally horizontal pivot axis located above said cross-member, and the other of said hydraulic cylinder/piston assemblies having one end pivotally connected to the other side of said gimbal ring for pivotal movement relative to said gimbal ring about said generally horizontal pivot axis.

14. A marine propulsion device as set forth in claim 13 wherein said gimbal ring further includes a pair of generally vertical, spaced apart side members each including a lower end, wherein said cross-member connects said side members of said gimbal ring, and wherein one of said support arms extends rearwardly from said lower end of one of said side members, and the other of said support arms extends rearwardly from said lower end of the other of said side members.

15. A marine propulsion device as set forth in claim 14 wherein each of said side members of said gimbal ring further includes an aperture centered on said pivot axis, and wherein said marine propulsion device further comprises a pivot pin extending through said apertures along said pivot axis and having one end extending outwardly of one of said side members and having said one end of said one of said hydraulic cylinder/piston assemblies pivotally mounted thereon, and an opposite end extending outwardly of the other of said side members and having said one end of said other of said hydraulic cylinder/piston assemblies pivotally mounted thereon.

16. A marine propulsion device comprising a gimbal housing adapted to be fixedly mounted on a boat transom, a gimbal ring pivotally mounted on said gimbal housing for pivotal movement relative to said gimbal housing about a generally vertical steering axis, said gimbal ring including opposite sides respectively having lower ends respectively including coaxial apertures, spaced apart support arms respectively extending rearwardly from said lower ends, means for preventing deflection of said support arms, said deflection preventing means includes a rigidifying sleeve extending coaxially with said apertures between said opposite sides of said gimbal ring, a pivot pin extending through said apertures and said sleeve and having one end extending outwardly of one of said sides of said gimbal ring, and an opposite end extending outwardly of the other of said slides of said gimbal ring, a propulsion unit extending rearwardly of said gimbal ring and being pivotally connected to said gimbal ring for pivotal movement relative to said gimbal ring about a generally horizontal tilt axis, said propulsion unit including a portion extending between said support arms for lateral support thereby, and a pair of hydraulic cylinder/piston assemblies pivotally connected between said gimbal ring and said propulsion unit for effecting pivotal movement of said propulsion unit relative to said gimbal ring about said tilt axis, one of said hydraulic cylinder/piston assemblies having one end pivotally connected to said one end of said pivot pin for pivotal movement relative to said gimbal ring about a generally horizontal pivot axis, and the other of said hydraulic cylinder/piston assemblies having one end pivotally connected to said opposite end of said pivot pin for pivotal movement relative to said gimbal ring about said generally horizontal pivot axis.

17. A marine propulsion device as set forth in claim 16 wherein said gimbal ring further includes a pair of generally vertical, spaced apart side members each including a lower end, and a generally horizontal cross-member extending across said lower end of said gimbal ring and connecting said side members of said gimbal ring, and wherein one of said support arms extends rearwardly from said lower end of one of said side members, and the other of said support arms extends rearwardly from said lower end of the other of said side members.

18. A gimbal ring adapted to be pivotally mounted on a boat transom for pivotal movement relative to the boat transom about a generally vertical steering axis, and also adapted to support a propulsion unit for pivotal movement relative to said gimbal ring about a generally horizontal tilt axis, said gimbal ring comprising a pair of generally vertical, spaced apart side members respectively including lower ends respectively having coaxial apertures defining a generally horizontal pivot axis, spaced apart support arms respectively extending rearwardly from said lower ends, and means for preventing deflection of said support arms, said deflection preventing means including a generally horizontal cross-member extending across and connecting said lower ends of said side members, a pivot pin extending through said apertures along said generally horizontal pivot axis and having one end extending outwardly of one of said side members and being adapted to connection to one end of a first hydraulic cylinder/piston assembly, and having an opposite end extending outwardly of the other of said side members and being adapted for connection to one end of a second hydraulic cylinder/piston assembly, which first and second hydraulic cylinder/piston assemblies being adapted for connection to the propulsion unit for effecting pivotal movement of the propulsion unit relative to said gimbal ring about the tilt axis.

19. A gimbal ring as set forth in claim 18 wherein said pivot axis passes through said cross-member, and wherein said cross-member includes an elongated opening pivotally receiving said pivot pin.

20. A gimbal ring adapted to be pivotally mounted on a boat transom for pivotal movement relative to the boat transom about a generally vertical steering axis, and also adapted to support a propulsion unit for pivotal movement relative to said gimbal ring about a generally horizontal tilt axis, and also adapted to have a pair of hydraulic cylinder/piston assemblies pivotally connected between said gimbal ring and the propulsion unit for effecting pivotal movement of the propulsion unit relative to said gimbal ring about the tilt axis, one of the hydraulic cylinder/piston assemblies having one end pivotally connected to one side of said gimbal ring for pivotal movement relative to said gimbal ring about a generally horizontal pivot axis, and the other of said hydraulic cylinder/piston assemblies having one end pivotally connected to the other side of said gimbal ring for pivotal movement relative to said gimbal ring about said generally horizontal pivot axis, said gimbal ring comprising a lower end, a pair of spaced apart support arms extending rearwardly from said lower end, and means for preventing deflection of said support arms, said deflection preventing means including, at said lower end, a generally horizontal cross-member having a rearward edge and located in a horizontal plane containing said generally horizontal pivot axis.

21. A gimbal ring as set forth in claim 20 wherein said gimbal ring further comprises a pair of generally vertical, spaced apart side members each including a lower end, wherein said cross-member connects said side members of said gimbal ring, and wherein one of said support arms extends rearwardly from said lower end of one of said side members, and the other of said support arms extends rearwardly from said lower end of the other of said side members.

22. A gimbal ring as set forth in claim 21 wherein each of said side members of said gimbal ring further includes an aperture centered on said pivot axis, and wherein said gimbal ring further comprises a pivot pin extending through said apertures along said pivot axis and having one end extending outwardly of one of said side members and being adapted to have the end of one of the hydraulic cylinder/piston assemblies pivotally mounted thereon, and an opposite end extending outwardly of the other of said side members of said gimbal ring and being adapted to have the end of the other of the hydraulic cylinder/piston assemblies pivotally mounted thereon.

23. A gimbal ring as set forth in claim 22 wherein said cross-member includes an elongated opening pivotally receiving said pivot pin.

24. A gimbal ring adapted to be pivotally mounted on a boat transom for pivotal movement relative to the boat transom about a generally vertical steering axis, and also adapted to support a propulsion unit for pivotal movement relative to said gimbal ring about a generally horizontal tilt axis, and also adapted to have a pair of hydraulic cylinder/piston assemblies connected between said gimbal ring and the propulsion unit for effecting pivotal movement of the propulsion unit relative to said gimbal ring about the tilt axis, one of the hydraulic cylinder/piston assemblies having one end pivotally connected to one side of said gimbal ring about a generally horizontal pivot axis, and the other of the hydraulic cylinder/piston assemblies having one end pivotally connected to the other side of said gimbal ring for pivotal movement relative to said gimbal ring about the generally horizontal pivot axis, said gimbal ring comprising a pair of spaced opposite sides each including respective means adapted for direct pivotal connection about the horizontal pivot axis to the respective cylinder/piston assemblies, a lower end, a pair of spaced apart support arms extending rearwardly from said lower end, and means for preventing deflection of said support arms, said deflection preventing means including a generally horizontal cross-member connecting said opposite sides adjacent said lower end and below said generally horizontal pivot axis.

25. A gimbal ring as set forth in claim 24 wherein said gimbal ring further comprises a pair of generally vertical, spaced apart side members each including a lower end, wherein said cross-member connects said side members of said gimbal ring, and wherein one of said support arms extends rearwardly from said lower end of one of said side members, and the other of said support arms extends rearwardly from said lower end of the other of said side members.

26. A gimbal ring as set forth in claim 25 wherein each of said side members of said gimbal ring further includes an aperture centered on said pivot axis, and wherein said marine propulsion device further comprises a pivot pin extending through said apertures along said pivot axis and having one end extending outwardly of one of said side members and being adapted to have the end of one of the hydraulic cylinder/piston assemblies pivotally mounted thereon, and an opposite end extending outwardly of the other of said side members and being adapted to have the end of the other of the hydraulic cylinder/piston assemblies pivotally mounted thereon.

27. A gimbal ring adapted to be pivotally mounted on a boat transom for pivotal movement relative to the boat transom about a generally vertical steering axis, and also adapted to support a propulsion unit for pivotal movement relative to said gimbal ring about a generally horizontal tilt axis, and also adapted to have a pair of hydraulic cylinder piston assemblies pivotally connected between said gimbal ring and the propulsion unit for effecting pivotal movement of the propulsion unit relative to said gimbal ring about the tilt axis, said gimbal ring comprising opposite sides separated by a given distance and respectively including lower ends respectively having apertures centered on a generally horizontal pivot axis and adapted to receive a pivot pin having one end extending outwardly from one of said sides of said gimbal ring for pivotal connection to one end of one of said cylinder/piston assemblies and having another end extending outwardly from the other of said sides of said gimbal ring for pivotal connection to one end of the other of said cylinder/piston assemblies, spaced apart support arms respectively extending rearwardly from said lower ends, and means for preventing deflection of said support arms, said deflection preventing means including a rigidifying sleeve adapted to surround said pivot pin between said opposite sides of said gimbal ring and having a length substantially equal to said given distance separating said opposite sides.

28. A gimbal ring as set forth in claim 27 wherein said gimbal ring further comprises a pair of generally vertical, spaced apart side members each including a lower end, a generally horizontal cross-member extending across said lower end of said gimbal ring and connecting said side members of said gimbal ring, and wherein one of said support arms extends rearwardly from said lower end of one of said side members, and the other of said support arms extends rearwardly from said lower end of the other of said side members.

29. A gimbal ring adapted to be pivotally mounted on a boat transom for pivotal movement relative to the boat transom about a generally vertical steering axis, and also adapted to support a propulsion unit for pivotal movement relative to said gimbal ring about a generally horizontal tilt axis, and also adapted to be pivotally connected to a pair of hydraulic cylinder/piston assemblies which, in turn, are connected to the propulsion unit for effecting pivotal movement of the propulsion unit relative to said gimbal ring about the tilt axis, said gimbal ring comprising a lower end, a pair of spaced apart support arms extending rearwardly from said lower end, means for preventing deflection of said support arms, said deflection preventing means including, at said lower end, a cross member extending in a horizontal plane, and means adapted for pivotal connection to the hydraulic cylinder/piston assemblies and having a pivot axis located in said horizontal plane.

* * * * *